United States Patent [19]

Rault

[11] 4,071,657

[45] Jan. 31, 1978

[54] METAL SHEET FOR DRAWING

[75] Inventor: Daniel Raymond Rault, Metz-Vallieres, France

[73] Assignee: Societe Lorraine de Laminage Continu, France

[21] Appl. No.: 628,600

[22] Filed: Nov. 4, 1975

[30] Foreign Application Priority Data

| | | |
|---|---|---|
| Nov. 6, 1974 | France | 74 36872 |
| Oct. 9, 1975 | France | 75 30984 |

[51] Int. Cl.[2] ..... B32B 15/00

[52] U.S. Cl. ..... 428/646; 148/12 C; 428/601; 428/648

[58] Field of Search ..... 29/183.5, 196, 196.5, 29/193, 194; 148/12 C; 428/577, 601, 646, 647, 648

[56] References Cited

U.S. PATENT DOCUMENTS

| | | | |
|---|---|---|---|
| 3,613,319 | 10/1971 | Takimura et al. | 29/148.4 D |
| 3,754,873 | 8/1973 | Bills et al. | 29/183.5 |

*Primary Examiner*—Arthur J. Steiner

*Attorney, Agent, or Firm*—Weingarten, Maxham & Schurgin

[57] ABSTRACT

A metal sheet which is intended to be subjected to a drawing operation for the fabrication of a shaped metal part has on its surface a roughness in the form of plateau portions in relief defining between them recessed valley portions, the average ratio of the dimension of the valley portions to the dimension of the plateau portions in any direction on the surface of the sheet being from 1:1 to 3:1, preferably 3:2 to 5:2, the average dimension of the plateau portions being from 40 to 200 micrometers, preferably 60 to 120 micrometers and the height of the plateau portions being more than 6 micrometers, preferably 10 to 25 micrometers. This surface roughness reduces the risk of seizing during drawing even if the sheet is coated with a soft metal such as tin. The sheet may be prepared by subjecting a metal sheet to pressure from at least one cold roller the surface of which has been treated, as by shot blasting, to provide the surface of the roller with similar roughness characteristics to those just defined but of which the height of the plateau portions is more than 7 micrometers, preferably 11 to 50 micrometers.

7 Claims, 1 Drawing Figure

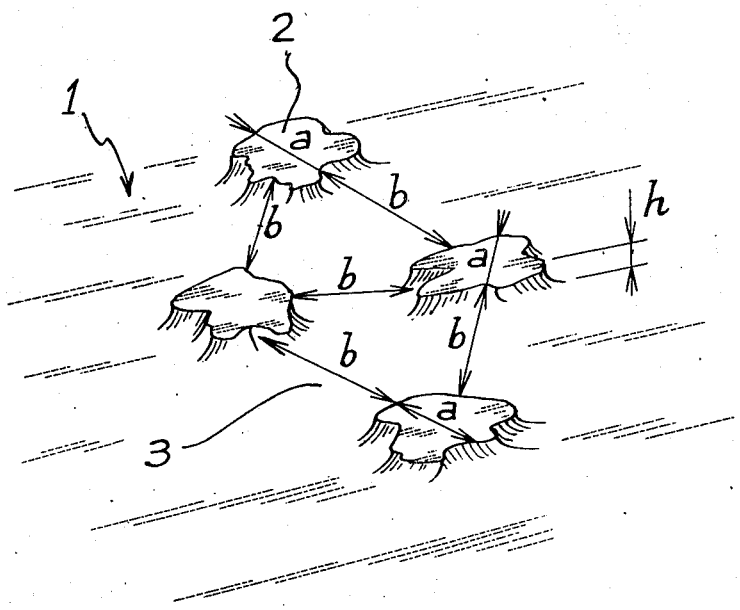
2
1
a
b
b
h
a
b
b
b
a
3

METAL SHEET FOR DRAWING

FIELD OF THE INVENTION

This invention relates to a metal sheet which is intended to be deep drawn or extra-deep drawn for the fabrication of shaped metal parts, and to a process for producing such a sheet.

PRIOR ART

When the forming of a metal sheet requires considerable sliding of the metal on forming tools, particularly in the case where the forming is effected by drawing, it is customary to use a sheet the surface of which has been made rough by passing the sheet between the rollers of a cold-rolling mill. The roughness of the sheet results from the formation on its surface of a succession of portions in relief, hereinafter referred to as peaks or plateaux, which define between them hollow portions hereinafter referred to as valleys. In order to obtain roughness of this kind, the surface of the cold rollers is treated by physical processes, such as shot-blasting, spark erosion, or electro-chemical processes. For example, it has been proposed to roughen the surface of a cold roller by blasting from 100 to 200 grains of shot of a diameter of from 500 to 700 microns per square millimeter of roller surface onto the surface of the roller in two or three passes.

It is current practice to consider that a surface having the highest number of plateaux as close as possible to one another possesses the best drawing properties (see text by John A. Newham in "Metal Deformation Processes, Friction and Lubrication," page 716, a book published by John A. Shey, 1970 —Marcel Dekker INC. — New York).

In the forming of sheet metal parts by drawing using a lubricant, the valleys present on the surface of the sheet constitute micro-reserves for the lubricant which results in the pinpoint reduction of adhesion between the micro-junctions formed between the surfaces of the sheet and of the forming tool with which they are in contact.

Despite the utilization of a lubricant of good quality and the existence of these micro-reserves, the phenomenon known as seizing occurs. Seizing occurs when a metallic deposit formed from debris torn from the surface of the sheet during the drawing is formed on the surface of the forming tool. The volume of this debris increases with the number of sheet parts drawn, thus increasing the seriousness of the damage caused by this debris on the surface of the drawn sheet. This damage ranges from simple fine scoring to a deep, wide furrow, with the formation of fragmented chips. The stresssing due to the increasing frictional force between the sheet part and the forming tool becomes such that the part breaks.

Losses of scratched or broken parts, wear on the forming tools, the frequency of stoppages of the presses or lines of presses, and the cost of reconditioning tools can be extremely high. In addition to the use of an anti-corrosion protective oil, it is necessary to apply localised lubrication to the surface of the sheet before drawing, using a mineral, vegetable, or animal oil, optionally containing conventional additives. This is the source of further disadvantages in various stages of production.

In particular, the parts then stick to the forming tools, making their automatic transfer difficult, while the tools, transfer devices, and equipment for handling the sheet parts are soiled with oil, which is harmful to the safety of personnel and equipment. Furthermore, the formed parts are difficult to degrease, which poses problems during their subsequent use, particularly when they have to be welded or surface coated.

Seizing also occurs when the sheet is covered on at least one of its faces with a metallic film, particularly a film of soft metal. The term "Soft metal" is here understood a metal such as lead, tin, copper, zinc, and, depending upon the metal of which the sheet to be drawn is made, aluminium.

In this case a sludge is formed, which is composed of the metal debris coming from the coating of soft metal on the sheet and the greasy lubrication residues, and which fouls and erodes the forming dies. Furthermore, when a long series of successive drawing operations is effected, there is a progressive deterioration of the surface state of the formed parts, particularly in the quality of brightness. This makes frequent stops necessary for the purpose of cleaning the forming dies or even for dismantling them for polishing purposes.

THE INVENTION

The invention seeks to obviate or minimise the above-mentioned shortcomings and to provide a metal sheet for deep or extra-deep drawing which, when simply coated with anti-corrosion oil or water-soluble oil in accordance with current standards and practice, avoids the occurrence of the phenomenon of seizing.

According to one aspect of the present invention as shown in the single drawing FIGURE there is provided a metal sheet 1 which is intended to be subjected to a drawing operation for the fabrication of a shaped metal part, said sheet comprising on its surface a roughness in the form of plateau portions 2 in relief defining between them recessed valley portions 3, the average ratio of the dimension of the valley portions 3 to the dimension a of the plateau portions 2 in any direction on the surface of the sheet being from 1:1 to 3:1, the average dimension of the plateau portions being from 40 to 200 micrometers and the height h of the plateau portions being more than 6 micrometers. Preferably, the average ratio, in any direction of the surface of the sheet, of the dimension of the valley portions or valley to the dimension of the plateau portions or plateaux is from 3:2 to 5:2, the average dimension of the plateaux is from 60 to 120 micrometers, and the average height of the plateaux is from 10 to 25 micrometers, these providing optimum characteristics for the surface roughness of the sheet.

The sheet possessing these surface characteristics may be coated on at least one of its faces with a metallic film, particularly a film of soft metal, such as tin.

According to another aspect of the present invention there is provided a process for production of the sheet just indicated, wherein a metal sheet is subjected to pressure from at least one cold roller, the surface of which has been treated to provide the surface of the roller with a roughness in the form of plateau portions in relief defining between them recessed valley portions, the average ratio of the dimension of the valley portions to the dimension of the plateau portions in any direction being from 1:1 to 3:1, the average dimension of the valley portions being from 40 to 200 micrometers and the height of the plateau portions being greater than 7 micrometers. For example, the surface of the roller may have been treated by shot-blasting onto the surface of the roller from 20 to 40 grains of shot of a mean diameter of 500 and 700 micrometers per square millimeter of roller surface.

The origin of the debris, which constitutes the metallic deposit characteristic of seizing, on the forming tools during the drawing of sheet metal workpieces cannot be simply explained from existing theoretical knowledge of the phenomena of friction and of wear of metal parts. Taking as a basis the fact that micro-welds or micro-adhesion occur at the contact interfaces between the peaks or plateaux of the opposing surfaces of the sheet and tool, this debris would in fact have to be microscopic and of a volume far smaller than the volume of the debris actually present on the seized surfaces or than the volume of metal actually shaved off from the surface of the sheet.

In order to avoid the phenomenon of seizing, the number and size of the pieces of debris must be as small as possible, and it must not be possible for this debris to become anchored to the surface of the drawing tool, this can be achieved with a sheet according to the invention.

In cases where the sheets are rolled in a cold-rolling mill before being supplied to the user, the spatial distribution and the dimensions defined above necessitate a considerable modification of the conditions of treatment of the surface of the cold-working rolling mill rollers.

The surface of these rollers must in fact then have a roughness characterized by an average ratio between the dimension of the plateau portions or plateaux and the dimension of the valley portions or valleys which is from 1:1 to 3:1, preferably from 3:2 to 5:2, an average valley dimension of 40 to 200 micrometers and preferably 60 to 120 micrometers, and a plateau height greater than 7 micrometers and preferably from 11 to 50 micrometers. The height of the plateaux on the surface of the rollers is selected to be greater than that which it is desired to obtain on the surface of the sheet, since the latter cannot exactly match in respect of depth the surface configuration of the rollers.

Thus, for example, for treatment by shot-blasting using a shot-blasting machine comprising a bladed turbine and shot of diameters from 500 to 700 microns, it is sufficient to blast onto the surface of the cold-working rolling mill rollers from 20 to 40 grains of shot per square millimeter of roller, preferably in only two passes. The amount of shot used is thus from 3 to 8 times less than that used in known processes.

PARTICULAR DESCRIPTION OF THE INVENTION AND EMBODIMENTS

The metal sheet according to the invention is found particularly advantageous for the large series production of drawn parts, particularly in the automobile industry, as will be seen from the Examples given below by way of indication.

In these Examples the results obtained with a sheet according to the present invention are compared with those obtained with a known sheet of the same thickness and same quality of metal, as used normally up to the present time for the production of the same parts with the aid of the same presses.

In Examples 1 and 3 the same lubricant was used for the sheet according to the invention and the known sheet. In Example 2 the use of a sheet according to the invention made it possible to dispense with the use of an extreme pressure oil as used for the drawing of known sheets.

EXAMPLE 1

| AUTOMOBILE SUSPENSION CUP | |
|---|---|
| Thickness of sheet | 3 mm. |
| Quality of metal | aluminum-killed extra-mild steel having mechanical characteristics according to French standard NF A 36401 |
| Press | 12-station transfer press |
| Lubricant | Soluble oil (unchanged) |
| Results | 500,000 parts drawn without seizing instead of 2,000. |

In this Example which is summarized above, a sheet of aluminium-killed extra-mild steel 3 mm. thick, and having on the surface a roughness characterized by a ratio of the valley dimension to the plateau dimension of an average of 2:1, an average plateau dimension of 120 micrometers and an average plateau height of 20 micrometers, permitted the uninterrupted drawing of 50,000 automobile suspension cups on a 12-station transfer press.

By way of comparison, in the drawing of identical parts with the same sheet which had not been treated by the process of the invention and thus did not have the aforesaid roughness characteristics, the need to de-seize the drawing tools permitted continuous drawing of only about 2,000 parts. The sheet according to the invention mentioned in this Example had been prepared by passing the sheet through a rolling mill provided with cold-rollers the surfaces of which had been treated by blasting on to the surfaces of the rollers about 25 to 30 grains of martensitic structure and of a diameter equal to about 700 micrometers per square millimeter of roller surface using a shot-blasting machine comprising a bladed turbine.

EXAMPLE 2

DOOR BOTTOM CONNECTION SHEET FOR A VEHICLE BODY

| | |
|---|---|
| Thickness of sheet | 0.80 mm. |
| Quality of metal | aluminum-killed extra-mild steel having mechanical characteristics according to French standard NF A 36 401 |
| Press | Double-acting mechanical |
| Lubricant | Elimination of extreme pressure oil |
| Results | Complete elimination of intervention in respect of the tools during a drawing period of 3 days, instead of a complete stoppage of the line of presses for two hours every 24 hours for attention to the tools. |

EXAMPLE 3

AIR CYLINDER

| | |
|---|---|
| Thickness of sheet | 2 mm. |
| Quality of metal | aluminum-killed extra-mild steel having the mechanical characteristics according to French standard NF A 36 401. |
| Press | Hydraulic |
| Lubricant | HOUGHTON 35 grease diluted with 50% water (unchanged) |
| Results | Complete elimination of intervention in respect of the tools instead of a complete stoppage of the press for 2 hours every 8 hours for attention to the tools. |

As already mentioned, the surface characteristics of the present metal sheet make it possible to avoid the occurrence of the phenomenon of seizing when this sheet is coated on at least one face with a metallic film, particularly a film of soft metal. It has in fact been found that the quantity of abrasive sludge is considerably reduced and that the surface state of the formed parts is definitely improved.

By way of indication it has been found that these advantages are particularly outstanding with a sheet coated on at least one of its faces with a coating of optionally recast tin. Where the sheet is coated on both faces, the thickness of the layers of tin deposited on each face may be the same or different. The thickness of the layer of tin should preferably not exceed for each face the equivalent of 15 grams per square metre.

By way of example a known tinned sheet, having on each face a coating of non-recast tin equivalent to about 5–6 grams per square meter, was compared with a sheet according to the present invention, which was tinned under the same conditions, was of the same thickness, but had on its surface a roughness characterized by a ratio of the dimension of the valleys to that of the plateaux of an average of 1:1, an average plateau dimension of 120 micrometers, and an average plateau height of 12 micrometers.

In the laboratory it was found that the sheet according to the invention had a coefficient of friction 15% lower than that of the known sheet.

These two sheets were used to produce, by drawing, tubes of a diameter of 16 mm., a length of 50 mm., and a thickness of 0.25 mm.. The sheet according to the present invention permitted the production of 20,000 tubes, that is to say one day's work, without intervention in respect of the tools, while the amount of sludge produced was practically nil. By way of comparison, the use of the known sheet necessitated frequent stoppages to clean the forming dies, and above all made it necessary to dismantle these dies twice a day for polishing purposes.

I claim:

1. A metal sheet which is intended to be subjected to a drawing operation for the fabrication of a shaped metal part, the entire surface of said sheet comprising:

a plurality of substantially similar plateau portions of predetermined dimension and height spaced from one another in both the transverse and longitudinal directions to define valley portions therebetween;

the average ratio of the dimension of said valley portions to the dimension of said plateau portions being from 1:1 to 3:1;

the average dimension of the plateau portions being from 40 to 200 micrometers;

the height of said plateau portions being greater than 6 micrometers.

2. The sheet of claim 1, wherein the average ratio of the dimension of the valley portions to the dimension of the plateau portions is from 3:2 to 5:2.

3. The sheet of claim 1, wherein the average dimension of the plateau portions is from 60 to 120 micrometers.

4. The sheet of claim 1, wherein the height of the plateau portions is from 10 to 25 micrometers.

5. The sheet of claim 1, and further comprising a coat of soft metal on at least one of its faces.

6. The sheet of claim 5, wherein the soft metal is tin.

7. The sheet of claim 5, wherein the thickness of the coat is such that the coat does not exceed 15 grams per square meter.

* * * * *

UNITED STATES PATENT AND TRADEMARK OFFICE

CERTIFICATE OF CORRECTION

PATENT NO. : 4,071,657

DATED : January 31, 1978

INVENTOR(S) : Daniel Raymond Rault

It is certified that error appears in the above-identified patent and that said Letters Patent are hereby corrected as shown below:

Column 2, line 38, "dimension" first instance, should read --dimension b--.

Signed and Sealed this

*Thirtieth* Day of *May 1978*

[SEAL]

*Attest:*

RUTH C. MASON
*Attesting Officer*

LUTRELLE F. PARKER
*Acting Commissioner of Patents and Trademarks*